US005467997A

United States Patent [19]

Bashirzadeh

[11] Patent Number: 5,467,997

[45] Date of Patent: Nov. 21, 1995

[54] METHOD OF USING INFORMATIONAL PLAYING CARDS

[76] Inventor: Ramin Bashirzadeh, 2807 Windsor Ridge Dr., Westborough, Mass. 01581

[21] Appl. No.: 354,547

[22] Filed: Dec. 13, 1994

[51] Int. Cl.[6] ..... A63F 1/00

[52] U.S. Cl. ..... 273/302; 273/308

[58] Field of Search ..... 273/302, 308, 273/298, 300, 301

[56] References Cited

U.S. PATENT DOCUMENTS

| | | | |
|---|---|---|---|
| 1,053,672 | 2/1913 | Stout | 273/302 |
| 1,123,622 | 1/1915 | Tercy | 273/302 |
| 1,273,024 | 7/1918 | Branch | 273/302 |
| 1,292,184 | 1/1919 | Wells | 273/302 |
| 1,570,475 | 1/1926 | Geraci, Jr. et al. | 273/298 |
| 1,641,015 | 8/1927 | Shore | 273/298 |
| 1,833,335 | 10/1876 | Sitterley | 273/302 |
| 4,071,247 | 1/1978 | Breslow | 273/308 |
| 4,546,982 | 10/1985 | Gaines et al. | 273/298 |

*Primary Examiner*—Benjamin H. Layno
*Attorney, Agent, or Firm*—Blodgett & Blodgett

[57] ABSTRACT

A deck of informational playing cards is disclosed, each card having a front surface with a primary printed indicia of a unique member of a class of items. The front surface also has a plurality of statistical elements directly related to the one member. Each element has a textual portion and a related numerical portion. The textual portion is substantially identical to the textual portion of the corresponding element on each of the cards. The value of the numerical portion varies among the corresponding elements and corresponds to the member. In playing a game, the players decide the basis for selecting the first and subsequent initiating players, for determining which of the statistical elements in a set prevails, and for determining who has won. The cards are dealt, one at a time and front surface down, to create a hand for each player. The front surface of only one of the cards in each of the hands is exposed. The first initiating player selects, from the exposed front surface in his or her hand, a statistical element most likely to prevail and reads it allowed. The other players read aloud the other statistical elements of the set. The players then determine which of the statistical elements prevails and the cards with the exposed front surfaces are given to the player having the prevailing statistical element. A subsequent initiating player is then selected and the process repeated until a player has won.

10 Claims, 1 Drawing Sheet

METHOD OF USING INFORMATIONAL PLAYING CARDS

BACKGROUND OF THE INVENTION

The field of invention relates generally to games, and more particularly, pertains to games involving informational playing cards.

A well known problem in designing a card game is to create a game that is both enjoyable and educational, while maintaining the participant's interest for an extended period of time. Although pictured playing cards are known in the field, they generally do not enumerate educational information, directly related to the item pictured, for both textual and pictorial reinforcement of the information in an entertaining context. Moreover, any pictorial card games known, rely heavily on the element of chance, and do not involve extensive skill.

These and other difficulties experienced with the prior art games have been obviated in a novel manner by the present invention.

It is, therefore, a principal object of the invention to provide a novel deck of informational playing cards with which it will be enjoyable to play.

Another object of this invention is the provision of a novel deck of informational playing cards that will be educational.

A further object of the present invention is the provision of a novel deck of informational playing cards that will maintain the interest of the user by relying more heavily on skill than chance.

It is another object of the instant invention to provide a novel deck of informational playing cards that will offer a variety of possible games from an individual deck.

With these and other objects in view, as will be apparent to those skilled in the art, the invention resides in the combination of pans set forth in the specification and covered by the claims appended hereto.

SUMMARY OF THE INVENTION

It has now been found that the foregoing and related objects may be readily attained in a deck of informational playing cards having a plurality of cards. Each of the cards has a front surface and a back surface. The front surface has a primary primed indicia of one member of a class of items. The class is the same for all of the cards, but the one member is unique for each of the cards.

The from surface also has secondary printed indicia depicting a plurality of statistical elements which are directly related to the one member depicted in the primary printed indicia. Each of the plurality of elements has a textual portion and a numerical portion related to the textual portion. The textual portion of each of the elements is substantially identical to the textual portion of the corresponding element on each of the cards. The numerical portion of each of the elements has a value which varies among the corresponding elements on each of the cards and corresponds to the member depicted in the primary indicia.

Preferably, the primary printed indicia includes a picture depicting the one member, and may also include textual indicia designating the one member.

Desirably, the class of items is a single sub-category of a category selected from the group consisting of sports, military, motor vehicle and geography. The single sub-category of the category of sports is selected from the group consisting of soccer, football, baseball, basketball, ice hockey, tennis, wrestling and golf. The single sub-category of the category of military is selected from the group consisting of fighter planes, helicopters, tanks, battleships, cannons and submarines. Additionally, the single sub-category of the category of motor vehicle is selected from the group consisting of stock cars (production model cars), racing cars, trucks, motorcycles, trains, and boats. Further, the single sub-category of the category of geography is selected from the group consisting of countries, states and cities.

In the method for playing a game, for two or more players, using the deck of informational playing cards, the players decide, among themselves, the basis for selecting the first initiating player and the basis for selecting subsequent initiating players. The players also decide the basis for determining which of the statistical elements in a set prevails over the other statistical elements in the set. The set is comprised of the statistical elements on an exposed front surface of only one of the cards in each of a plurality of hands of the players, having substantially identical textual portions. There is only one prevailing statistical element for each of the sets. The players also decide the basis for determining which of the players has won the game.

Each of the informational playing cards is dealt, one at a time and with its front surface down, to the players, in rotation, to create a hand of cards for each of the players.

After making the above decisions and dealing, the front surface of only one of the cards in each of the hands is exposed by the player who has been dealt the hand. The exposed front surface is visible only to the player who has been dealt the hand.

Using the basis previously decided upon among the players, one of the players is selected as the first initiating player to begin play. The first initiating player then selects, from the exposed front surface of the one card in his or her hand, a statistical element most likely to prevail over the other statistical elements in the set containing the selected statistical element.

The first initiating player then reads aloud the selected statistical element, followed by the other players, who read aloud the other statistical elements of the set containing the selected statistical element.

Using the basis previously decided among the players, the players then determine which of the statistical elements, in the set containing the selected statistical element, prevails over the other statistical elements in the set. The trick, comprising the card with the exposed front surface of each of the hands, is given to the player having the prevailing statistical element.

After giving the trick, a subsequent initiating player is selected in accordance with the basis previously decided upon by the players. The process is repeated with the subsequent initiating player replacing the first initiating player and exposing only one card in his or her hand and selecting the statistical element most likely to prevail.

The game continues until it is determined by the players, using the basis previously decided upon, that one of the players has won the game.

Preferably, the basis for selecting the first initiating player is to select the first player to volunteer to commence play.

The basis for selecting the subsequent initiating player is to select the player given the trick.

The basis for determining which of the statistical elements in a set prevails over the other statistical elements in the set is to select the statistical element in the set with the numerical portion having the highest value. In the alternative, the basis may be to select the statistical element in the set with the numerical value having the lowest value.

Desirably, when the trick is given, the cards of the trick are added to the hand of the player having the prevailing statistical element, and, the basis for determining the player who has won the game is to select the player who has won all of the cards. Alternatively, the basis for determining the player who has won the game is to select the player who has won the greatest number of tricks after the hands have been played once. As a further alternative, the basis for determining the player who has won the game is to select the player who has the greatest number of cards after a predetermined period of play.

In the preferred method of playing the game, the front surface of only one of the cards in each of the hands is exposed by means of the player who has been dealt the hand holding his or her hand in a stack, so that the front surface of each of the cards in the hand faces the player, but with only the front surface of a top card of the hand being visible to the player.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT(S)

Figure 1:
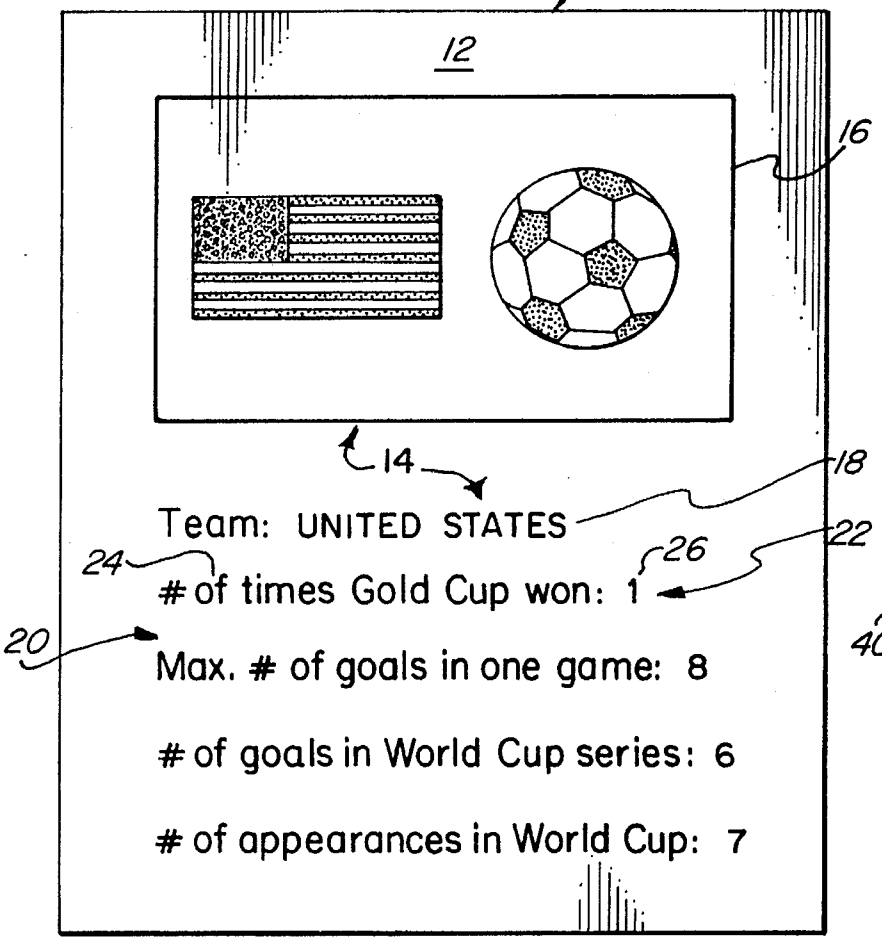
FIG. 1 is a front elevational view of an informational playing card, embodying the principals of the present invention, and showing the front surface thereof.

With reference now to the drawings, there is shown in FIG. 1, an informational playing card, embodying the principals of the present invention, and generally indicated by the reference numeral 10. Typically, either thirty-six or forty-eight informational playing cards 10 are combined to form a deck (not shown), but any similar number may be used.

The informational playing card 10 has a front surface 12 and a back surface (not shown). The front surface 12 has a primary printed indicia, generally indicated by the numeral 14, of one member of a class of items. The primary printed indicia 14 includes a picture 16 depicting the one member, and may also include textual indicia 18 designating the one member. In the example shown in FIG. 1, the picture 16 depicts a soccer ball and the flag of the U.S. to connote the U.S. soccer team. The textual indicia 18 designates "Team: United States".

The class is the same for all of the cards 10 in the deck (not shown), but the member is unique for each of the cards 10. In the example shown in FIG. 1, the primary printed indicia 14 of all of the cards in the deck (not shown) would depict soccer teams, but the primary printed indicia 14 of each card would depict a separate team.

The class of items is a single sub-category of a category. The categories include, by way of example, sports, military, motor vehicle and geography, but other categories may be used with similar success. The sub-categories of the category "sports" may include soccer, football, baseball, basketball, ice hockey, tennis, wrestling and golf. The subcategories of the category "military" may include fighter planes, helicopters, tanks, battleships, cannons and submarines. Similarly, the subcategories of the category "motor vehicle" may include stock ears (production model cars), racing cars, trucks, motorcycles, trains, and boats. In a like manner, the subcategories of the category "geography" may include countries, states and cities. For all of the categories, other sub-categories than those listed above could be employed with satisfactory results.

The back surface (not shown) of each informational playing card 10 in a deck (not shown) may be either blank, decorated with a non-descript design or decorated with a design representative of the particular subcategory of the deck (not shown).

Referring still to FIG. 1, the from surface 12 of the informational playing card 10 also includes secondary printed indicia, generally indicated by the reference numeral 20. The secondary primed indicia 20 is comprised of a plurality of statistical elements, the first of which is generally indicated by the reference numeral 22. A typical informational playing card 10 will have between 4 and 8 statistical elements, but it may have more or less, as desired.

Each of the statistical elements is directly related to the one member depicted in the primary printed indicia 14,—i.e. the U.S. soccer team. Statistical element 22, by way of example, has both a textual portion 24 and a numerical portion 26, which is related to the textual portion 24. In FIG. 1, the statistical element 22 reads "# of times Gold Cup won: 1". The textual portion 24 of the statistical element 22 reads, "# of times Gold Cup won:", while the numerical portion 26 of the statistical element 22 is, "1". (It should be noted that the numerical elements shown in FIG. 1 are for exemplary purposes only and may not be numerically correct for the listed soccer team.)

The textual portions will appear on each of the informational playing cards 10 in the deck (not shown) and preferably in the same order. However, the numerical portion that corresponds to any one textual portion will have a value which varies among the corresponding elements on each of the cards 10 and corresponds to the member depicted in the primary indicia for that card.

By way of example, another card (not shown) of the deck related to soccer may have a primary printed indicia (not shown) which depicts the Brazilian soccer team. The textual portion 24, which reads "# of times Gold Cup won:" will appear on this other card (not shown), but the associated numerical value may be "3".

The invention having been thus described, the operation will now be clear to those of ordinary skill in the art as described below.

The deck (not shown) of informational playing cards 10 may be used for playing a game for two or more players. Either before or immediately after dealing the cards, the players make several decisions that dictate the version and nature of the game that will be played.

One decision that the players need to make is how they will select the first initiating player in the game. This may be done in a number of well known ways such as selecting the first player to volunteer, using relative age as a determining factor, using the player that picks the card with the highest numerical portion for some predetermined statistical element, etc.

The players also need to decide how they will select subsequent initiating players. One basis may be to select the player that won the immediately preceding hand.

Another decision made by the players is the basis to employ for determining which of the statistical elements in a set prevails over the other statistical elements in the set. The set is made up of the statistical elements that have substantially identical textual portions on the exposed from surface of only one of the cards in each of the hands of the players. There is only one prevailing statistical element for each set. The basis for determining which of the statistical elements in a set prevails over the other statistical elements in the set may be to select the statistical element in the set with the numerical portion having the highest value. Alternatively, the basis may be to select the statistical element in the set with the numerical portion having the lowest value.

A final determination made by the players is the basis for determining which of the players has won the game. It may be decided that the player who has won the game is the player who has won all of the cards. Alternatively, it may be decided that the player who has won is the player who has won the greatest number of tricks after the hands have been played once. As a still further alternative, it may be decided that the winner is the player who has the greatest number of cards after a predetermined period of play.

Each of the informational playing cards are dealt, one at a time and with its front surface down, to the players, in rotation, to create a hand of cards for each of the players. After the cards are dealt and the above decisions are made, each of the players exposes the front surface of only one of the cards in his or her hand, so that the exposed front surface is visible only to the player who has been dealt the hand. This can be accomplished by leaving all of the cards of the hand face down on the playing surface and exposing only one of the cards. It may also be accomplished by having each of the players hold his or her hand in a stack, so that the front surface of each of the cards in the hand faces the player, but with only the front surface of a top card of the hand being visible to the player.

Play is commenced by using one of the methods mentioned above to select one of the players as the first initiating player to begin play. Once selected, the first initiating player selects, from the front surface of the exposed card in his or her hand, a statistical element most likely to prevail over the other statistical elements in the set containing the selected statistical element. The first initiating player then reads the selected statistical element aloud.

The other players then read aloud the other statistical elements of the set containing the statistical element selected by the first initiating player. These elements will be the ones in their respective exposed cards having the same textual portion.

The players then determine which of the statistical elements, in the set containing the selected statistical element, prevails over the other statistical elements in the set, using the basis decided upon by the players, as described above. The player with the prevailing statistical element is given the trick which is comprised of the card with the exposed front surface of each of the hands.

A subsequent initiating player is selected in accordance with the basis decided upon by the players, as described above. The subsequent initiating player then takes over the role played by the first initiating player by exposing only one of the cards in his or her hand and selecting from the exposed front surface of that card a statistical element most likely to prevail over the other statistical elements in the set containing the selected statistical element.

The process is repeated until it is determined by the players that one of the players has won the game, in accordance with the basis decided upon by the players.

The informational playing card 10, shown in FIG. 1, is typically formed from cardboard, a synthetic resin, or a combination of both. Typical dimensions are approximately 9.0 centimeters by approximately 6.5 centimeters for the card 10, and approximately 3.0 centimeters by approximately 5.3 centimeters for the picture 16.

Figure 2:
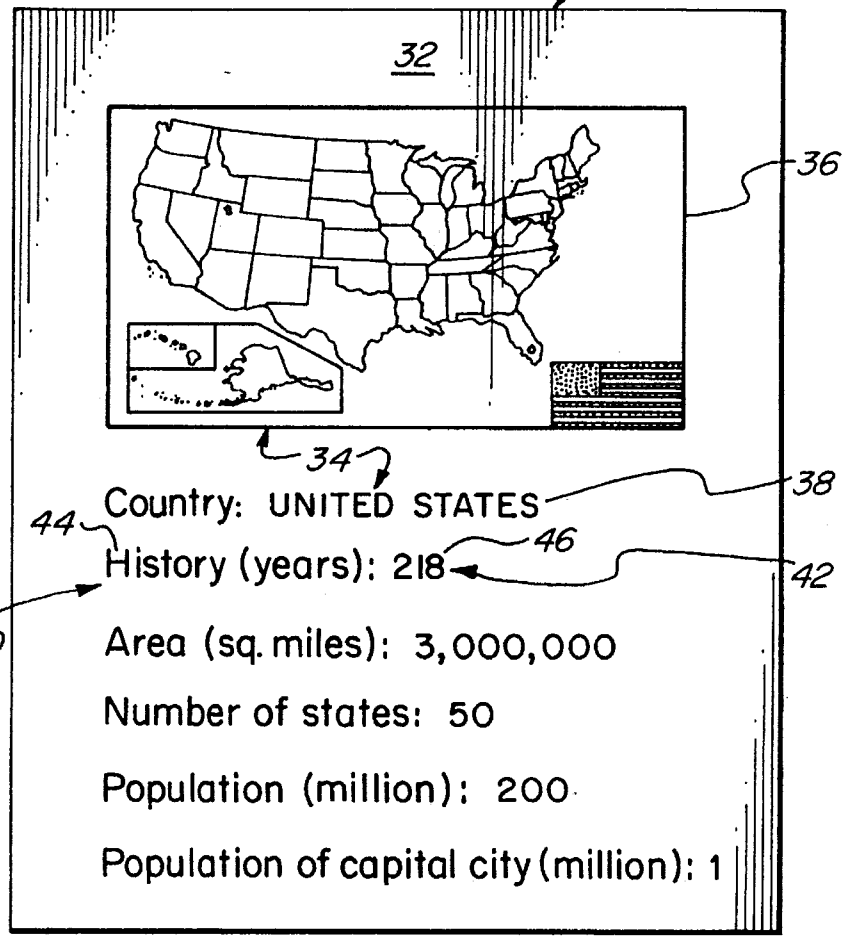
FIG. 2 is a front elevational view of an alternate embodiment of an informational playing card, embodying the principals of the present invention, and showing the front surface thereof.

Referring to FIG. 2, there is shown an alternate embodiment of an informational playing card, embodying the principals of the present invention, and generally indicated by the reference numeral 30.

As in the first embodiment, the informational playing card 30 has a front surface 32 and a back surface (not shown). The front surface 32 has a primary printed indicia, generally indicated by the numeral 34, of one member of a class of items. The primary printed indicia 34 includes a picture 36 depicting the one member, and may also include textual indicia 38 designating the one member. In the example shown in FIG. 2, the picture 36 depicts a map of the U.S. and its flag to connote that country. The textual indicia 38 designates "Country: United States". The primary printed indicia 34 of all of the cards in the deck (not shown) would depict countries, but the primary printed indicia 34 of each card would depict a separate country.

Referring still to FIG. 2, the front surface 32 of the informational playing card 30 also includes secondary printed indicia, generally indicated by the reference numeral 40. The secondary printed indicia 40 is comprised of a plurality of statistical elements, the first of which is generally indicated by the reference numeral 42.

Each of the statistical elements is directly related to the one member depicted in the primary printed indicia 34, i.e.—the U.S. As for the first embodiment, statistical element 42 has both a textual portion 44 and a numerical portion 46 which is related to the textual portion 44. The same is true for the other statistical elements.

As with the first embodiment, the textual portions will appear on each of the informational playing cards 30 in the deck (not shown) and preferably in the same order. However, the numerical portion that corresponds to any one of the textual portions will have a value which varies among the corresponding elements on each of the cards 30 and corresponds to the member depicted in the primary indicia for that card.

Thus, it can be seen from the foregoing detailed specification and attached drawings that the deck of informational playing cards of the present invention provides a game which is both enjoyable to play and educational. It maintains the interest of the user by relying more heavily on skill than chance, and offers a variety of possible games from an individual deck of cards.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

I claim:

1. A method of playing a game, for two or more players, using a deck of informational playing cards, the method comprising the steps of:

(a) providing a plurality of playing cards, each of the cards having a front surface and a back surface, the front surface having:

(1) a primary printed indicia of one member of a class of items, the class being the same for all of the cards, the one member being unique for each of the cards; and (2) secondary printed indicia depicting a plurality of statistical elements, the plurality of elements being directly related to the one member depicted in the primary printed indicia, each of the plurality of elements having a textual portion and a numerical related to the textual portion, the textual portion of each of the elements being substantially identical to the textual portion of the corresponding element on each of the cards, the numerical portion of each of the elements having a value which varies among the corresponding elements on each of the cards and corresponds to the member depicted in the primary indicia;

(b) deciding among the players:

(1) the basis for selecting the first initiating player;

(2) the basis for selecting subsequent initiating players;

(3) the basis for determining which of the statistical elements in a set prevails over the other statistical elements in the set, the set being comprised of the statistical elements on an exposed front surface of only one of the cards in each of a plurality of hands of the players, having substantially identical textual portions, there being only one prevailing statistical element for each of the sets; and (4) the basis for determining which of the players has won the game;

(c) dealing each of the plurality of informational playing cards, one at a time and with its front surface down, to the players, in rotation, to create a hand of cards for each of the players;

(d) after steps (a) through (c), exposing the front surface of only one of the cards in each of the hands by the player who has been dealt the hand, so that the exposed front surface is visible only to the player who has been dealt the hand;

(e) selecting, using the basis decided upon among the players in step (b)(1), one of the players as the first initiating player to begin play;

(f) selecting by the first initiating player, from the exposed front surface of the only one card in the hand of the first initiating player, a statistical element most likely to prevail over the other statistical elements in the set containing the selected statistical element;

(g) reading aloud, by the first initiating player, the selected statistical element;

(h) after reading aloud the selected statistical element, reading aloud, by the other players, the other statistical elements of the set containing the selected statistical element;

(i) determining which of the statistical elements, in the set containing the selected statistical element, prevails over the other statistical elements in the set, using the basis decided upon by the players in step (b)(3);

(j) giving the trick to the player having the prevailing statistical element, the trick comprising the card with the exposed front surface of each of the hands;

(k) after giving the trick, selecting a subsequent initiating player in accordance with the basis decided upon by the players in step (b)(2); and (l) repeating steps (d) through (k), with the subsequent initiating player selected in step (k) replacing the initiating player in step (e), until it is determined by the players that one of the players has won the game, in accordance with the basis decided upon by the players in step (b)(4).

2. The method of playing a game of claim 1 wherein, in the deciding step, the basis for selecting the first initiating player is to select the first player to volunteer to commence play.

3. The method of playing a game of claim 1 wherein, in the deciding step, the basis for selecting the subsequent initiating player is to select the player given the trick in step (j).

4. The method of playing a game of claim 1 wherein, in the deciding step, the basis for determining which of the statistical elements in a set prevails over the other statistical elements in the set is to select the statistical element in the set with the numerical portion having the highest value.

5. The method of playing a game of claim 1 wherein, in the deciding step, the basis for determining which of the statistical elements in a set prevails over the other statistical elements in the set is to select the statistical element in the set with the numerical portion having the lowest value.

6. The method of playing a game of claim 1 wherein, in the giving step, the cards of the trick are added to the hand of the player having the prevailing statistical element, and, wherein in the deciding step, the basis for determining the player who has won the game is to select the player who has won all of the cards.

7. The method of playing a game of claim 1 wherein, in the deciding step, the basis for determining the player who has won the game is to select the player who has won the greatest number of tricks after the hands have been played once.

8. The method of playing a game of claim 1 wherein, in the deciding step, the basis for determining the player who has won the game is to select the player who has the greatest number of cards after a predetermined period of play.

9. The method of playing a game of claim 1 wherein, in the exposing step, the front surface of only one of the cards in each of the hands is exposed by holding each of the hands by the player who has been dealt the hand, in a stack, so that the front surface of each of the cards in the hand faces the player, but with only the front surface of a top card of the hand being visible to the player.

10. A method of playing a game, for two or more players, using a deck of informational playing cards, the method comprising the steps of:

(a) providing a plurality of playing cards, each of the cards having a front surface and a back surface, the front surface having:

(1) a primary printed indicia of one member of a class of items, the class being the same for all of the cards, the one member being unique for each of the cards; and (2) secondary printed indicia depicting a plurality of statistical elements, the plurality of elements being dimefly related to the one member depicted in the primary printed indicia, each of the plurality of elements having a textual portion and a numerical portion related to the textual portion, the textual portion of each of the elements being substantially identical to the textual portion of the corresponding element on each of the cards, the numerical portion of each of the elements having a value which varies among the corresponding elements on each of the cards and corresponds to the member depicted in the primary indicia;

(b) deciding among the players:

(1) that the basis for selecting the first initiating player is to select the first player to volunteer to commence play;

(2) that the basis for selecting subsequent initiating players is to select the player given the trick in step (j);

(3) that the basis for determining which of the statistical elements in a set prevails over the other statistical elements in the set, is to select the statistical element in the set with the numerical portion having the highest value; and (4) that the basis for determining which of the players has won the game is to select the player who has won the greatest number of tricks after the hands have been played once;

(c) dealing each of the plurality of informational playing cards, one at a time and with its front surface down, to the players, in rotation, to create a hand of cards for each of the players;

(d) after steps (a) through (c), holding each of the hands by the player who has been dealt the hand, in a stack, so that the front surface of each of the cards in the hand faces the player, but with only the front surface of a top card of the hand being visible and only to the player who has been dealt the hand;

(e) selecting, using the basis decided upon among the players in step (b)(1), one of the players as the first initiating player to begin play;

(f) selecting by the first initiating player, from the front surface of the top card of the first initiating player, a statistical element most likely to prevail over the other statistical elements in the set containing the selected statitistical element;

(g) reading aloud, by the first initiating player, the selected statistical element;

(h) after reading aloud the selected statistical element, reading aloud, by the other players, the other statistical elements of the set containing the selected statistical element;

(i) determining which of the statistical elements, in the set containing the selected statistical element, prevails over the other statistical elements in the set, using the basis decided upon by the players in step (b)(3);

(j) giving the trick to the player having the prevailing statistical element, the trick comprising the top card of each of the hands;

(k) after giving the trick, selecting a subsequent initiating player in accordance with the basis decided upon by the players in step (b)(2); and (l) repeating steps (d) through (k), with the subsequent initiating player selected in step (k) replacing the initiating player in step (e), until it is determined by the players that one of the players has won the game, in accordance with the basis decided upon by the players in step (b)(4).

* * * * *